US008615816B2

(12) United States Patent
Harimoto

(10) Patent No.: US 8,615,816 B2
(45) Date of Patent: Dec. 31, 2013

(54) SHORTS FOR MALE

(76) Inventor: Yoshiharu Harimoto, Suita (JP)

( * ) Notice: Subject to any disclaimer, the term of this patent is extended or adjusted under 35 U.S.C. 154(b) by 476 days.

(21) Appl. No.: 12/223,973

(22) PCT Filed: Feb. 27, 2006

(86) PCT No.: PCT/JP2006/303572

§ 371 (c)(1),
(2), (4) Date: Dec. 4, 2008

(87) PCT Pub. No.: WO2007/097015

PCT Pub. Date: Aug. 30, 2007

(65) Prior Publication Data

US 2009/0300826 A1 Dec. 10, 2009

(51) Int. Cl.
*A41B 9/02* (2006.01)

(52) U.S. Cl.
USPC ..... 2/403; 2/400

(58) Field of Classification Search
USPC ..... 2/400–407
See application file for complete search history.

(56) References Cited

U.S. PATENT DOCUMENTS

| | | | | | |
|---|---|---|---|---|---|
| 2,138,481 | A | * | 11/1938 | Chatfield | 602/69 |
| 2,164,281 | A | * | 6/1939 | McDonald | 2/403 |
| 2,239,972 | A | * | 4/1941 | Rauser | 2/403 |
| 2,258,411 | A | * | 10/1941 | Fiagg | 2/403 |
| 2,369,773 | A | * | 2/1945 | Brenner | 2/403 |
| 2,416,108 | A | * | 2/1947 | Lloyd | 2/405 |
| 2,438,310 | A | * | 3/1948 | Ashe et al. | 2/403 |
| 2,471,348 | A | * | 5/1949 | Redmond | 2/403 |
| 2,570,498 | A | * | 10/1951 | Senderowitz | 2/403 |
| 2,702,388 | A | * | 2/1955 | Wise | 2/403 |
| 3,038,471 | A | * | 6/1962 | Van Horne | 602/67 |
| 3,166,764 | A | * | 1/1965 | Stedman et al. | 2/403 |
| 5,029,345 | A | * | 7/1991 | Angheluta et al. | 2/403 |
| 5,499,404 | A | * | 3/1996 | Marchiorello | 2/403 |
| 5,524,298 | A | * | 6/1996 | Plunkett | 2/403 |

(Continued)

FOREIGN PATENT DOCUMENTS

| | | |
|---|---|---|
| GB | 599858 | 3/1948 |
| JP | A-52-45435 | 4/1977 |

(Continued)

OTHER PUBLICATIONS

Supplementary European Search Report issued from the European Patent Office on Jun. 23, 2009 in the corresponding European patent application No. 06 71 4709.

(Continued)

*Primary Examiner* — Shelley Self
*Assistant Examiner* — Richale Quinn
(74) *Attorney, Agent, or Firm* — Muncy, Geissler, Olds & Lowe, PLLC

(57) ABSTRACT

A shorts S for a male, the shorts having a front opening portion 100 where a pair of cloth members 4, 4' are overlapped, the front opening portion being capable of forming an opening 101 allowing insertion of a penis P for urination. Of respective edge portions 1X, 1Y of the two cloth members 4, 4' forming the opening 101, an upper end of one of the edge portions is joined in an overlapped manner to the other cloth member; and lower ends 1B, 1D of the two edge portions 1X, 1Y are jointed to each other at a width-wise center 16 of the front opening portion 100.

10 Claims, 12 Drawing Sheets

(56) References Cited

U.S. PATENT DOCUMENTS

| | | | | |
|---|---|---|---|---|
| 6,425,140 | B1 * | 7/2002 | Vitches | 2/403 |
| 6,557,183 | B1 * | 5/2003 | Truong et al. | 2/403 |
| 6,898,805 | B1 | 5/2005 | Truong et al. | |
| 7,788,739 | B1 * | 9/2010 | Della Ratta | 2/403 |

FOREIGN PATENT DOCUMENTS

| | | |
|---|---|---|
| JP | U-4-13603 | 2/1992 |
| JP | A-08-100302 | 4/1996 |
| JP | A-2000-248413 | 9/2000 |
| JP | U-3101985 | 3/2004 |
| JP | U-311224 | 6/2005 |
| JP | A-2005-264411 | 9/2005 |

OTHER PUBLICATIONS

International Search Report dated Mar. 8, 2006 in corresponding PCT application No. PCT/JP2006/303572.

Notification of Transmittal of the Translation of the International Preliminary Report on Patentability dated Sep. 12, 2008 in corresponding PCT application No. PCT/JP2006/303572.

* cited by examiner

SHORTS FOR MALE

TECHNICAL FIELD

The present invention relates to a shorts for male having a front opening portion where a pair of cloth members are overlapped, the front opening portion being capable of forming an opening allowing insertion of a penis for urination.

BACKGROUND ART

A conventional shorts for male (referred to as "shorts" hereinafter) is as shown in FIGS. 19-23 for example. FIGS. 19 and 20 show a front view and a rear view of the conventional shorts S', respectively.

In the front face of the shorts S', there is provided a front opening portion 100' capable of forming an opening 101. At this front opening 100', there are disposed a pair of cloth members 1*a*, 2*a*, overlapped one on the other (hatched portion in FIG. 21), and edge portions 2X, 2Y of the respective cloth members 1*a*, 2*a* being not sewn with the other cloth member. For urination, approximate mid points 2E, 2F of the respective edge portions 2X, 2Y are pulled away from each other to form the opening 101 (FIGS. 21, 22). And, through this opening 101 formed by deforming the cloth members 1*a*, 2*a*, the penis P can be inserted.

In the cloth members 1*a*, its portion upwardly of an upper end 2A of the edge portion 2X and a further portion downwardly of a lower end 2B of the same are sewn and joined with the other cloth member 2*a*. On the other hand, in the cloth members 2*a*, its portion upwardly of an upper end 2C of the edge portion 2Y and a further portion downwardly of a lower end 2D of the same are sewn and joined with the other cloth member 1*a*. The four points formed by the upper ends 2A, 2C and the lower ends 2B, 2D are set on front crotch cut if, 2*f*, so that the front opening portion 100' is formed substantially quadrangle by the overlapping of the two cloth members 1*a*, 2*a*.

As shown in FIG. 22, in association with the deformation of the cloth members 1*a*, 2*a* in the course of the formation of the opening 101, the end portions of the edge portion 2X are displaced to positions of an upper end 2A' and a lower end 2B' and the ends of the edge portion 2Y are displaced to positions of an upper end 2C' and a lower end 2D'. As described above, the deformation of the front opening portion 100' takes place over the entire shorts S' as shown by e.g. the displacement of a waist position W to a position W.

The front opening portion 100' comprised of the quadrangle interconnecting the four points of the upper ends 2A, 2C and the lower ends 2B, 2D has a significant area of overlapping between the two cloth members 1*a*, 2*a* and this portion 100' is formed rather flat (see FIG. 23). Therefore, in order to form the opening 101, the respective edge portions 2X, 2Y need to be displaced by large amounts, so this opening operation is troublesome. For this reason, with the conventional shorts S', in an attempt to minimize the opening movement, the edge portions 2X, 2Y are curved toward the center of the shorts S', thereby reducing the overlapping area between the cloth members 1*a*, 2*a*.

Incidentally, as the above-described prior art is of general technical contents, no specific prior-art document is cited.

DISCLOSURE OF THE INVENTION

1. Problem to Be Solved by Invention

When a user is wearing the shorts S', the base of his penis P is located generally adjacent downwardly of the front opening portion 100', in the front view (FIG. 21). In a normal mode of use, the position of the formed opening 101 is located adjacent the intersection of the diagonal lines of the quadrangle formed by the four points of the upper ends 2A, 2C and the lower ends 2B, 2D. Namely, the position of the opening 101 is upwardly of the position of the base of the penis P when wearing of the shorts S' (FIG. 22), with no agreement between these two positions.

Further, when the opening 101 is formed, the cloth members 1*a*, 2*a* intersect each other upwardly and downwardly of the opening 101, and are being forcibly deformed. This causes the penis P to be pressed by the cloth members 1*a*, 2*a* from the right and left sides. Further, when the user tries to direct the leading end of his penis P downwards for urination, there will occur interference between an intermediation portion of the penis P and the opening 101, which causes the urinary tract to be compressed from downward, thus providing resistance against the urination. As a result, there will occur incomplete urination, and residual urine, if any, may leak from the penis P.

In order to avoid such feeling of incomplete urination, in inserting the penis P into the opening 101 to the outside, the user may sometimes displace forcibly the opening 101 to the position of the penis P so that the position of the penis P and the position of the opening 101 may be in as much agreement as possible. In such case, although the urinary tract will be less compressed by the cloth members 1*a*, 2*a* from downward, as the force needs to be maintained for obtaining the agreement between the position of the opening 101 and the position of the penis P, this action too is troublesome.

Therefore, the object of the present invention is to provide a shorts for male, which allows speedy and easy urination and which reduces the feeling of incomplete urination.

2. Means To Solve Problem

For accomplishing the above-noted object, according to a first characterizing construction of a shorts for a male according to the present invention, the male shorts has a front opening portion where a pair of cloth members are overlapped, the front opening portion being capable of forming an opening allowing insertion of a penis for urination, characterized in that of respective edge portions of the two cloth members forming said opening, an upper end of one of the edge portions is joined in an overlapped manner to the other cloth member; and lower ends of the two edge portions are jointed to each other at a width-wise center of said front opening portion.

With the above-described first characterizing construction, as an upper end of one of the edge portions is joined in an overlapped manner to the other cloth member; and lower ends of the two edge portions are jointed to each other at a width-wise center of said front opening portion, the two cloth members are overlapped in the form of a triangle generally.

In comparison with the conventional shorts with the two cloth members being overlapped in the form of a quadrangle generally, the inventive shorts has a smaller amount of overlapping between the two cloth members.

When wearing the shorts, the base of the male user's penis P is located generally adjacent downwardly of the front opening portion in the front view. In the case of the inventive construction, when the opening is formed, the deformation of each cloth member occurs around the center end portion of the front opening portion as the pivot for the deformation, so that this opening is located immediately upwardly of the end of this center portion. That is, there is achieved substantial agreement between the position of the base of the penis P of the user wearing the shorts and the position of the opening. Therefore, it is possible to reduce the amount of the opening movement of the cloth members for forming the opening and to allow urination to be effected speedily. Further, as the user need not displace the opening to the position of his penis, the user can urinate easily.

Further, thanks to the agreement between the position of the opening formed and the position of the base of the penis, there will occur less compressing of the urinary tract from downward during the urination. Consequently, urine can be discharged substantially completely, so that there will occur no feeling of incomplete urination or leak of residual urine to the shorts, either.

According to a second characterizing construction of the present invention, there is provided an engaging means comprised of mutual convex overlapping between the two cloth members when the shorts is worn.

With the above-described second characterizing construction, when the shorts is worn by a user, the two cloth members are overlapped in a three-dimensional manner with accommodating the user's penis therein. This restricts right/left positional displacement between the two cloth members, so that the opening will not be formed unless the user effects an opening operation knowingly. That is to say, the above construction can preclude inadvertent formation of the opening called "split" when the user assumes a certain posture unintentionally.

According to a third characterizing construction of the present invention, said engaging means comprises a convex portion formed by darts treatment provided in each one of the two cloth members.

With such engaging means formed by darts treatment, the area for holding the penis can be formed more convex than otherwise. And, with the engaging means thus formed, the tensed condition of the cloth members can be lessened as compared with the conventional construction having two cloth members overlapped flatly. So, the opening operation can be facilitated.

Further, as the construction results in less compression to the penis during wearing, there is provided improvement in the wearing feel also.

According to a fourth characterizing construction of the present invention, said each edge portion is formed convex to the outside relative to said width-wise center.

With the above-described fourth characterizing construction, there is provided increase in the engaging area between one cloth member and the other cloth member by an amount corresponding to the curving of each edge portion. Hence, inadvertent formation of the opening can be prevented more reliably.

According to a fifth characterizing construction of the present invention, said front opening portion has a vertically elongate, approximately triangular shape; the joint between the lower ends of the two edge portions is provided at a vertically intermediate position of the front opening portion; and the lower end of the front opening portion is located on the back side of the base of the penis.

With the above-described fifth characterizing construction, of the front opening portion, a portion thereof extending from the position of the joint between the edge portions and the lower end will snugly fit to the vicinity of the back side of the base of the penis.

Therefore, there is provided an effect of lightly pressing the urinary tract during urination, thus preventing incomplete urination. Further, as the construction improves the supporting feel to the vicinity of the back side of the base of the penis, there is provided a shorts of greater wearing comfort.

BEST MODE OF EMBODYING THE INVENTION

FIGS. 1-15 show a shorts for a male according to the present invention.

The inventive shorts S for male (referred to as "shorts S" hereinafter) is constructed such that the position of the base of the penis P and the position of the opening 101 are in substantial agreement with each other so as to facilitate urination and to restrict occurrence of incomplete urination.

More particularly, the shorts S has a front opening portion 100 where a. pair of cloth members 4, 4' are overlapped, the front opening portion 100 being capable of forming an opening 101 allowing insertion of a penis P for urination, wherein of respective edge portions 1X, 1Y of the two cloth members 4, 4' forming the opening 101, an upper end of one of the edge portions is joined in an overlapped manner to the other cloth member; and lower ends of the two edge portions are jointed to each other at a width-wise center 16 of the front opening portion 100.

At the front opening portion 100, the two cloth members 4, 4' are disposed in an overlapped manner (the hatched portion in FIG. 7). And, the edge portion 1X (1Y) of the respective cloth member 4 (4') is not sewn with the other cloth member 4' (4). Therefore, when intermediate portions 1E and 1F of the respective edge portions 1X, 1Y are pulled away from each other, there is formed the opening 101 for allowing insertion of the penis P (FIG. 8).

As shown in FIG. 7, of the edge portions 1X, 1Y forming the opening 101, for example, an upper end 1A of the edge portion 1X of the cloth 4 is sewn and joined with the other cloth member 4. Whereas, an upper end 1C of the edge portion 1Y of the cloth member 4 is sewn and joined with the other cloth member 4. Lower ends 1B, 1D of the edge portions 1X, 1Y are joined with each other at the center 16 of the front opening portion 100. The center 16 comprises a sewing line for connecting the cloth members 4, 4' with each other.

In the instant embodiment, the lower ends 1B, 1D are in substantially positional agreement each other. However, such agreement is not always needed. Rather, the lower ends 1B, 1D should be located as close as possible to each other. With such substantial agreement between the lower ends 1B, 1D, the two cloth members 4, 4' are overlapped in the form of a triangle generally.

With the shorts S of this construction, as the lower ends 1B, 1D are in substantial agreement with each other, the two cloth members 4, 4' are overlapped in the approximately triangular shape, thus minimizing the overlapping area therebetween. With this, it becomes possible to reduce the amount of opening movement required for forming the opening 101, so that urination can proceed speedily and easily.

(Forming Position of Opening)

When a user is wearing the shorts S, the base of his penis P is located at the downward vicinity of the front opening portion 100 as seen in the front view (FIG. 7).

FIG. 10 shows a diagram illustrating the front opening portion 100 of the inventive shorts S as being superposed with the front opening 100' of the conventional shorts S'.

On the other hand, when the opening 101 is formed (FIG. 8), if the end of the center 16 of the front opening portion 100 is provided as a connecting portion 102, the respective cloth members 4, 4' will be deformed about this connecting portion 102 as the pivot for the deformation, so that the opening 101 will be located immediately upwardly of this connecting portion 102.

That is to say, the position of the penis P of the user when wearing the shorts S and the position of the opening 101 will be very close to each other. Therefore, the user will need not largely displace the opening 101 toward his penis P for urination, so that the user may urinate in a comfortable and relaxed manner.

FIG. 9 is a view showing only the front opening portion 100 schematically.

As may be apparent from this view, when the opening 101 is formed immediately upwardly of the connecting portion 102, the position of the base of the penis P and the position of the opening 101 approach each other, thus restricting compression of the urinary tract by the cloth members 4, 4' from downward. This will restrict occurrence of incomplete urination as well as subsequent occurrence of leak of residual urine to the shorts S.

(Engaging Means)

As shown in FIGS. 7, 8 and 11, the inventive shorts S includes an engaging means 110, 110' comprised of mutual convex overlapping of the two cloth members 4, 4' when the shorts S is worn.

For example, the engaging means 110, 110' may be formed by pre-forming the cloth members 4, 4' in a three-dimensional form. As shown in FIGS. 12 and 13, the engaging means 110, 110' may be formed easily as a convex portion 111 by providing each one of the two cloth members 4, 4' with a darts treated portion 8 subjected to a darts treatment. In this, the base end of the darts treated portion 8 becomes the apex T of the convex portion 111.

With the above-described provision of the engaging portions 110, 110' which are formed three-dimensional when accommodating the penis P of the user wearing the shorts S, compression of the penis P can be restricted, so that the wearing comfort can be improved.

As an alternative construction of the engaging means 110, 110', there may be provided two sheets of elastic cloth members containing rubber material interwoven therein, so that the two cloth members 4, 4' are overlapped simply flatly when the shorts S is not worn, but are overlapped three-dimensionally when accommodating the penis P of the user when wearing the shorts S.

Further, as the inventive shorts S' is capable of accommodating the penis P three-dimensionally, the tension of the cloth members can be lessened as compared with the case of two cloth members being overlapped flatly. As a result, the opening/closing operation of the opening 101 is facilitated to make easier the insertion of the penis P therethrough to the outside, whereby the urination may proceed even more speedily.

Further, as the two cloth members 4, 4' are overlapped in the three-dimensional manner when accommodating the penis P of the user when wearing the shorts S, Hence, the opening 101 will not be formed unless an opening operation is carried out intentionally. That is to say, it is possible to preclude inadvertent formation of the opening 101 when the user assumes a certain posture unintentionally.

(Shape of Edge Portions)

In the instant embodiment, each edge portion 1X, 1Y is formed convex to the outer side relative to the width-wise center 16.

The front opening portion 100 of the shorts S of the present invention is formed as an approximately triangular portion having minimal overlapping between the two cloth members 4, 4'. However, as each edge portion 1X, 1Y is formed curved to the outer side, the portion where there occurs friction between one cloth member and the other cloth member is increased by an amount corresponding to the curvature, so that the inadvertent formation of the opening 101 can be prevented.

(Front Opening Portion)

As shown in FIG. 14, the front opening portion 100 formed by joining of the two cloth members 4, 4' has a vertically elongate, approximately triangular shape, with the connecting portion 102 between the lower ends of the two edge portions 1X, 1Y being located at the vertical intermediate portion of the front opening portion 100 and the lower end 103 of the front opening portion 100 being located on the back side of the base of the penis P.

With the above-described construction, the two cloth members 4, 4', between the connecting portion 102 and the lower ends 103, can be configured to fit snugly to the back side of the base of the penis P.

Therefore, the urinary tract will be pressed lightly during urination, thereby restricting occurrence of incomplete urination, and improving the support feel adjacent the back side of the base of the penis P, thus improving the wearing comfort of the shorts S.

Method of Manufacturing Inventive Male Shorts

FIGS. 1 through 4 show a completed shorts S. FIGS. 5 and 6 show the respective parts constituting the shorts S. In the following discussion, the upper portion of the shorts S across inter-sewing line 14, 14' between the leg band portions 3 and the hip cups 5 will be referred to as an upper half and the lower portion of the same will be referred as a lower half, respectively.

A belt portion 20 is formed by joining a front girdle 1 and hip girdles 2, 2' via inter-sewing lines 6, 6'. The hip cup 5 and the hip girdle 2 with a cut-in line L being overlapped with an overlapping line L2 are joined to each other via a sewing line 13. Similarly, a hip cup 5' and a hip girdle 2' with a cut-in line L1' being overlapped with an overlapping line L2' are jointed to each other via an inter-sewing line 13'. As these parts are sewn together via crotch cut sewing line along the rear centerline 10-11, the upper half of the shorts S is formed.

The left and right leg band portions 3, 3' are connected via an inter-sewing line 9 provided on the back side of the shorts S. Similarly, a darts treated portion 8 of the cloth member 4 is subjected to a darts forming treatment and the other cloth member 4 also is subjected to a darts forming treatment (FIGS. 12 and 13).

Via an inter-sewing line 16 provided at the crotch bottom of the cloth member 4, the left and right cloth members 4, 4' are connected to each other (FIGS. 11 and 15). The cloth member 4 and the leg band portions 3 are connected to each other via the crotch cut sewing line 7 and the other cloth member 4' is also connected via the inter-sewing line 7'.

As the front and rear crotch lower portions are sewn together via the inner crotch sewing line 17 of the leg band portion 3, the lower half of the shorts S is formed.

Then, the lower end portion of the hip band portion 20 and the upper end portion of the leg band portion 30 are connected to each other via inter-sewing lines 12, 14, 14', whereby the shorts S is completed.

[Other Embodiment ]

In the foregoing embodiment, as a rear side member, a construction capable of providing "hip-up" effect can be provided. This rear side member, as shown in FIGS. 16-18, includes the hip cups 5, 5'. More particularly, portions of the cloth members constituting the hip cups 5 are overlapped as joining portions M, M', thus forming outwardly projecting conical portions 130, 130'.

Next, with reference to FIG. 5, etc., a process for forming the conical portion 130 of the hip cup 5 will be described.

On the inter-sewing line 13 between the hip cup 5 and the hip girdle 2, an AH point is set at a position away from a point DH by a first predetermined distance. A point V is set at a position away by a second predetermined distance from a point CH downwardly of the hip cup 5. Then, on a line interconnecting the point AH and the point CH, a point H is determined at a position away by a third predetermined distance from the point V. Then, about this point H as the center, a circle Q having a radius R from the point H and the point V is drawn. The resultant circle Q is used as the basis for the cone which determines the height of the hip cup 5.

The height of the resultant triangle H·AH·V (apex: H, bottom side AH·V) becomes the height K of the cone. Then, by extending one side V·H of the triangle, H·AH is obtained. Then, as the overlapping portion M2 shown in FIG. 18 is overlapped with the joining portion M, the cone of the hip cup 5 is completed.

As the radius R of this circle varies according to the size of the hip, the size of the hip cup can be changed. The angle forming the joining portion M of the hip cup is 45 degrees, regardless of the size.

The joining portion M may be constructed such that a portion thereof remains un-sewn.

When the overlapping portion M2 is overlapped with the joining portion M, the cut-in portion L, L' shown in FIG. 18 may be provided as free portions 131, 131' which remain not sewn with the lower cloth member, so that the overlapped cloth members are displaceable relative to each other. Therefore, in accordance with the volume of the hip of the user wearing the shorts S, displacement can readily occur. Displacement occurs also in accordance with a movement of the wearer and the construction functions also as a "vent" through which air can enter and exit in response to the movement. As the result, the construction provides the characteristics of warp knitted structure, so that loosening will not occur.

With the above-described provision of the conical portions 130, the flesh of the hip is comfortably accommodated within the conical portion 130. And, the flesh of the hip will be gathered toward the apexes H of the conical portion 130, without constricting the hip, thus providing "hip-up" effect and hip-shaping effect.

Further, with such hip-up effect, it is also possible to avoid lower back pain due to weight of the hip flesh.

With the inventive shorts S for male, the position of the opening 101 of the male shorts S is caused to agree substantially with the position of the base of the penis P, so that incomplete urination is prevented. And, if the conical portions 130 as the rear side members are provided as in the present embodiment, it becomes possible to enhance the exercising effect for the gluteus maximus muscle, thus building up the muscle around the penis P, so that the effect of preventing incomplete urination may be further improved.

It may be said that the shorts S according to the present invention is a shorts S with distinguished ergonomic performance, in view of the structure of the human body and the construction of the shorts. That is, as the opening position of the front opening portion is made different from the opening position of the conventional shorts S' in order to be adapted to the structure of the penis (position, three-dimensional shape), the feeling of incomplete urination is restricted and the amount of opening movement of the cloth members as the movement for forming an opening for urination is decreased, thus enabling speedy urination.

Further, with the provision of the conical portion as the rear side member, there is provided the hip-up effect.

When wearing the shorts having the above-described functions, the user can recognize improved feel of secure at the time of urination, improvement in the aesthetic appearance around the hip, so the user will feel greater satisfaction.

Industrstrial Applicability

The male shorts according to the present invention may be used not only as a shorts to be worn daily, but as a shorts for sports, etc.

DESCRIPTION OF REFERENCE MARKS

Figure 1:
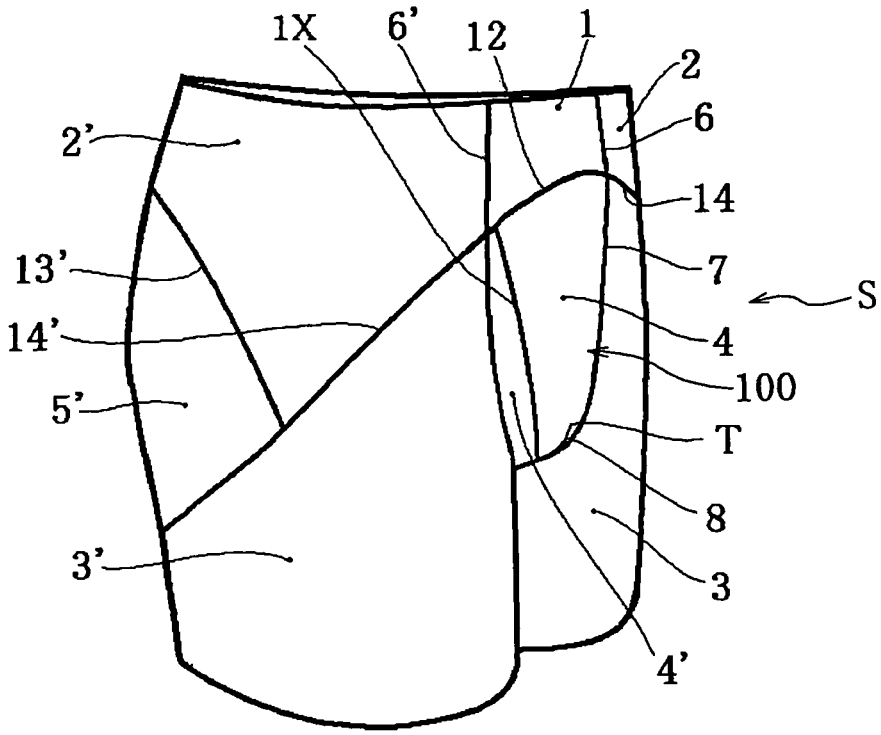
FIG. 1 a diagonally frontal schematic view of the male shorts according to the present invention, FIG. 2 a diagonally rear schematic view of the male shorts according to the present invention, FIG. 3 a front schematic view of the male shorts according to the present invention, FIG. 4 a rear schematic view of the male shorts according to the present invention, FIG. 5 a view schematically showing a basic drafting of the male shorts according to the present invention, FIG. 6 a diagram showing respective parts constituting the male shorts according to the present invention, FIG. 7 a schematic of a front opening portion, FIG. 8 a schematic showing the front opening portion when forming an opening, FIG. 9 a schematic showing the front opening portion when forming an opening, FIG. 10 a diagram showing the front opening portion of the inventive shorts as being overlapped with a front opening portion of a conventional shorts, FIG. 11 a section along I-I' of the front opening portion, FIG. 12 a schematic of a cloth member prior to a darts forming treatment, FIG. 13 a schematic of the cloth member after the darts forming treatment, FIG. 14 a schematic showing periphery of the front opening portion formed by connecting two cloth members, FIG. 15 a schematic illustrating connecting operation of the two cloth members, FIG. 16 a rear perspective view of the principal portions of the male shorts having conical portions on the rear side, FIG. 17 a front perspective view of principal portions of the conical portions, FIG. 18 a schematic showing a hip cup when it is developed, FIG. 19 a front schematic showing a conventional male shorts, FIG. 20 a rear schematic showing the conventional male shorts, FIG. 21 a schematic showing the front opening portion of the conventional male shorts, FIG. 22 a schematic showing the front opening portion forming an opening, of the conventional male shorts, and FIG. 23 a section along Z-Z' of the conventional male shorts.
Figure 2:
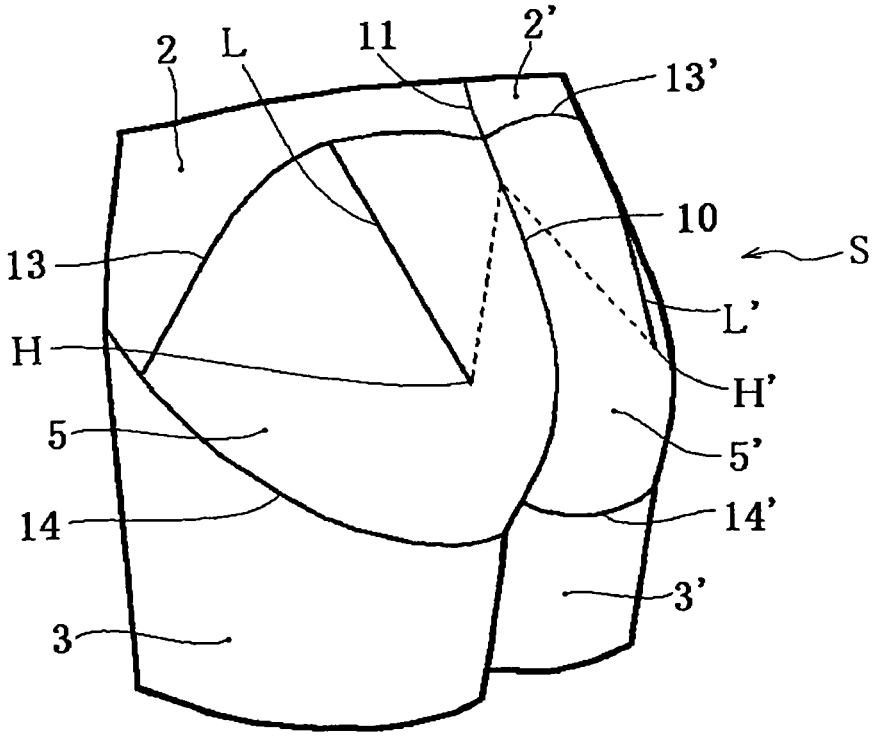
Figure 3:
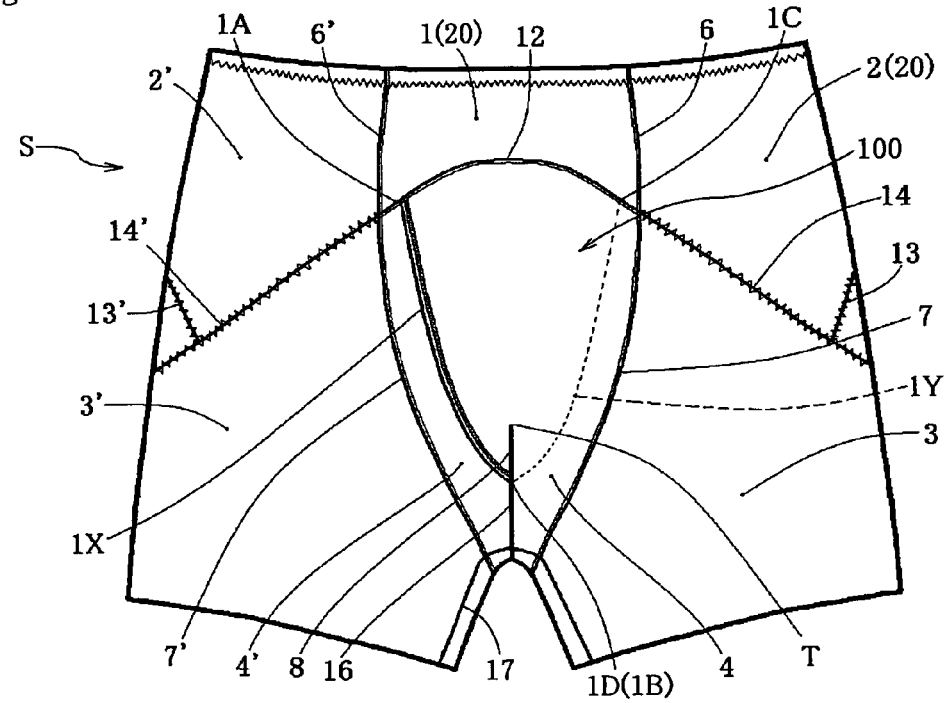
Figure 4:
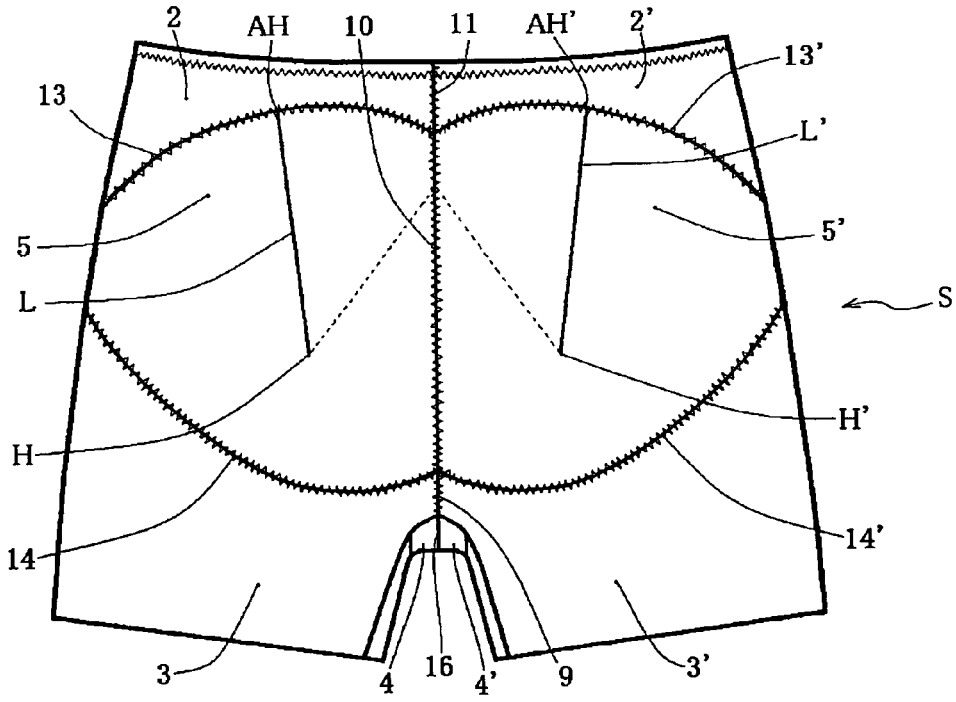
Figure 5:
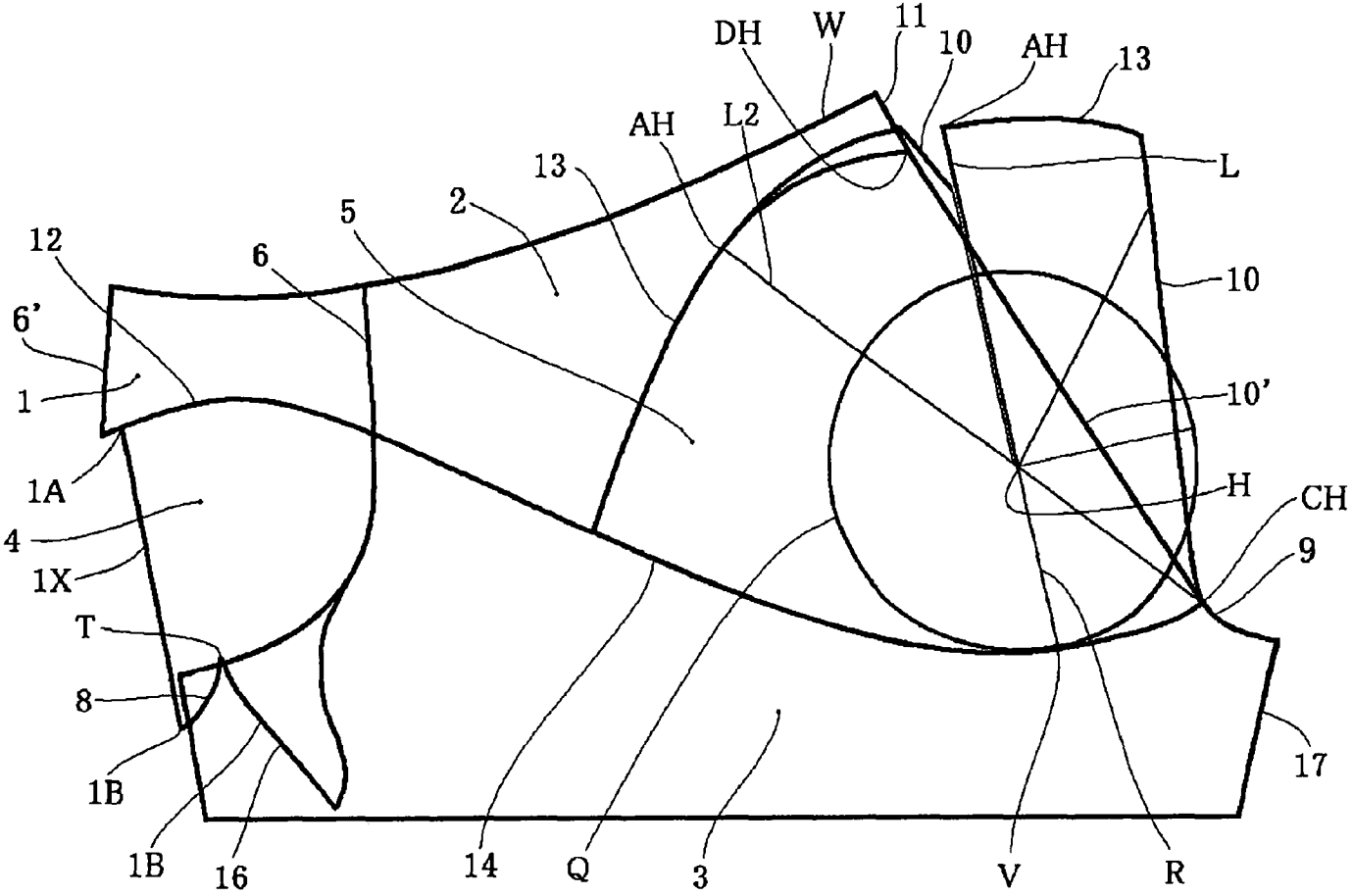
Figure 6:
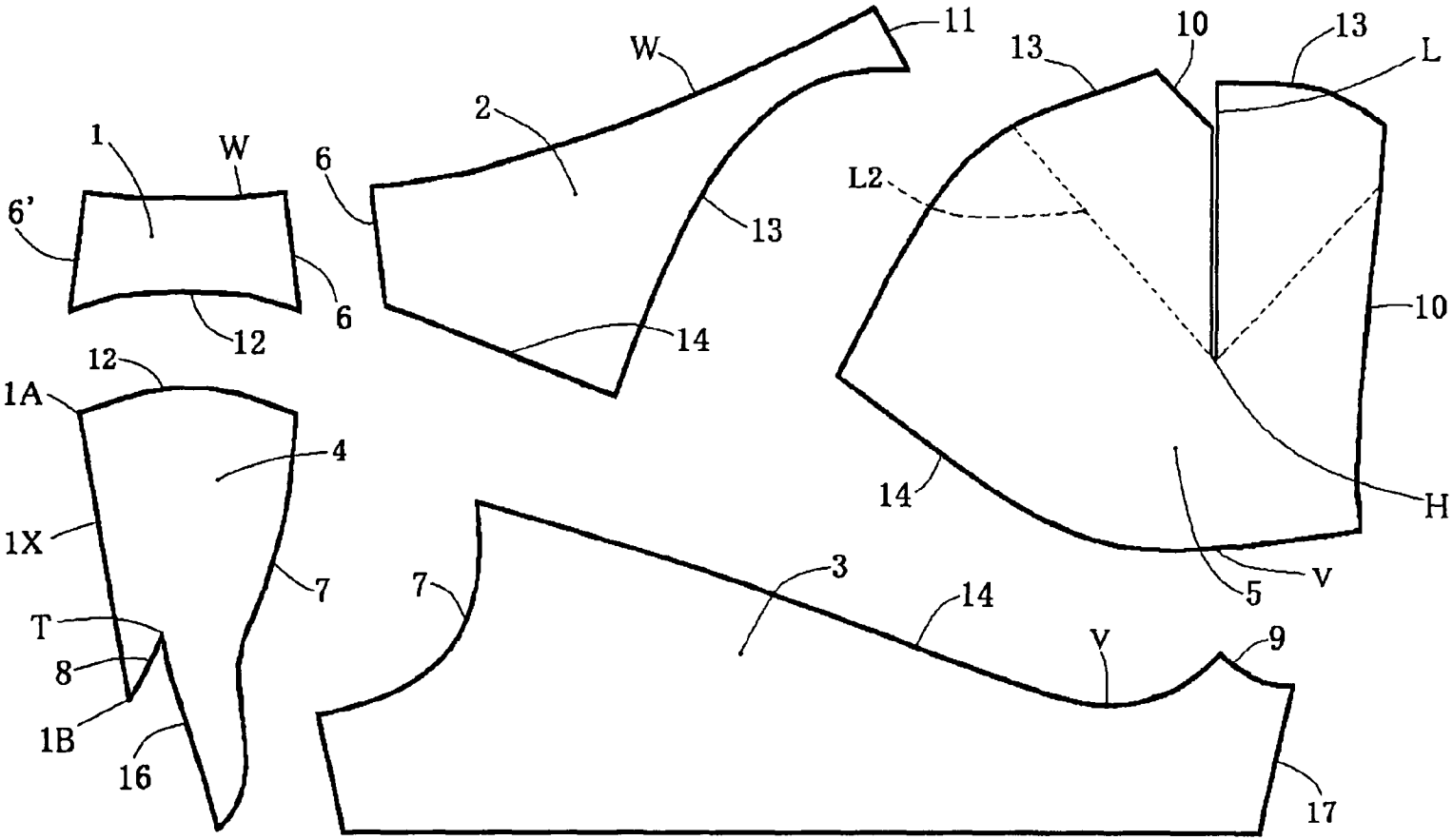
Figure 7:
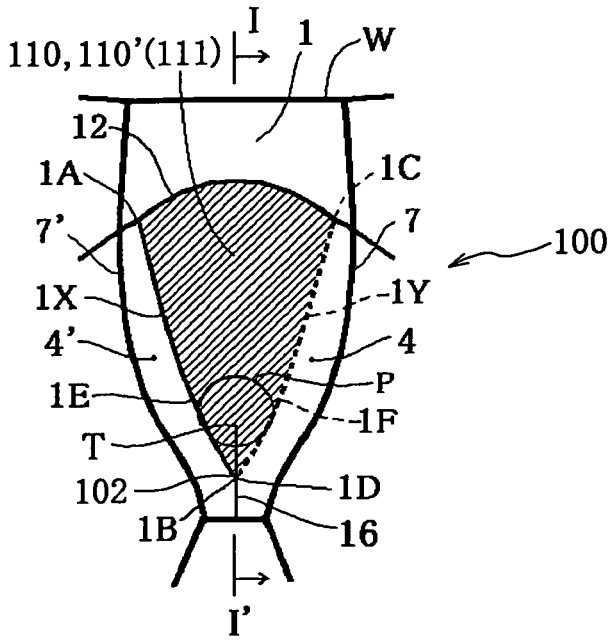
Figure 8:
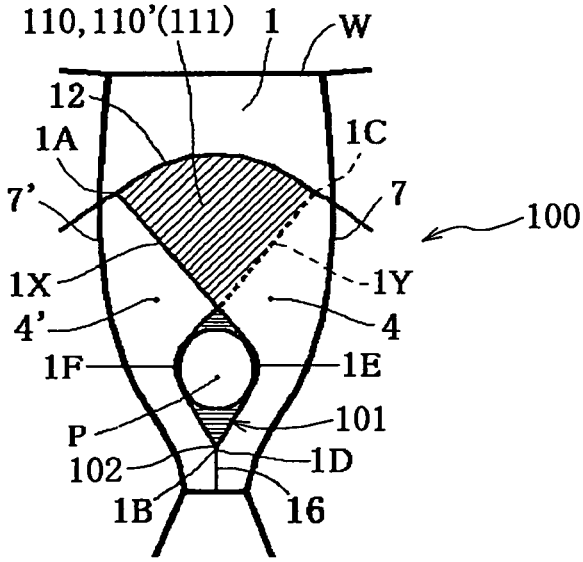
Figure 9:
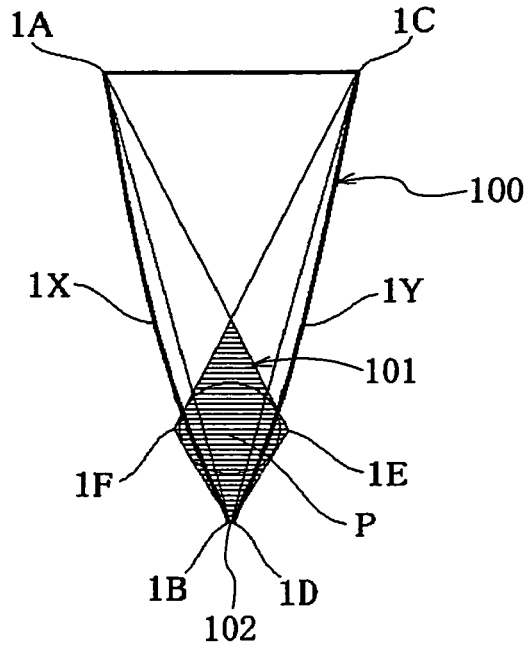
Figure 10:
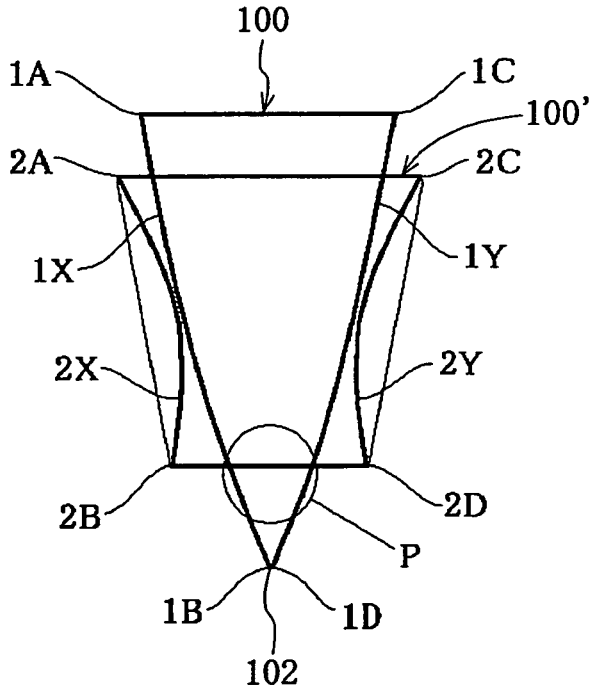
Figure 11:
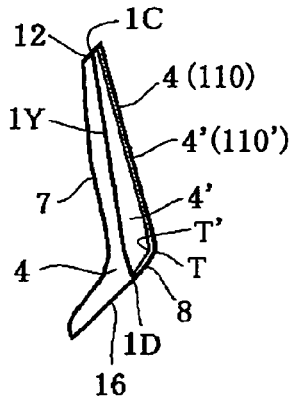
Figure 12:
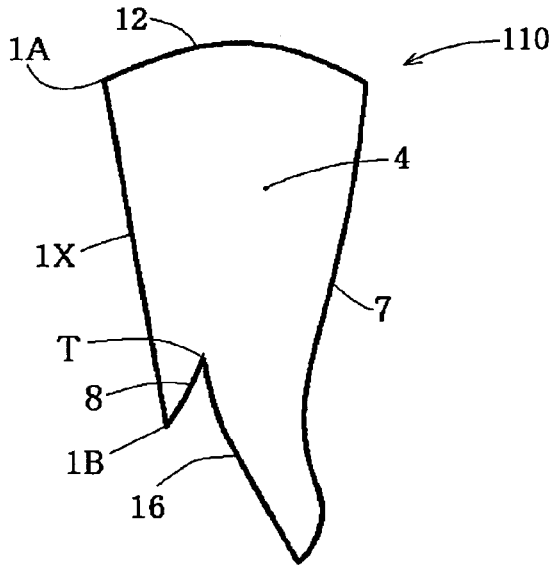
Figure 13:
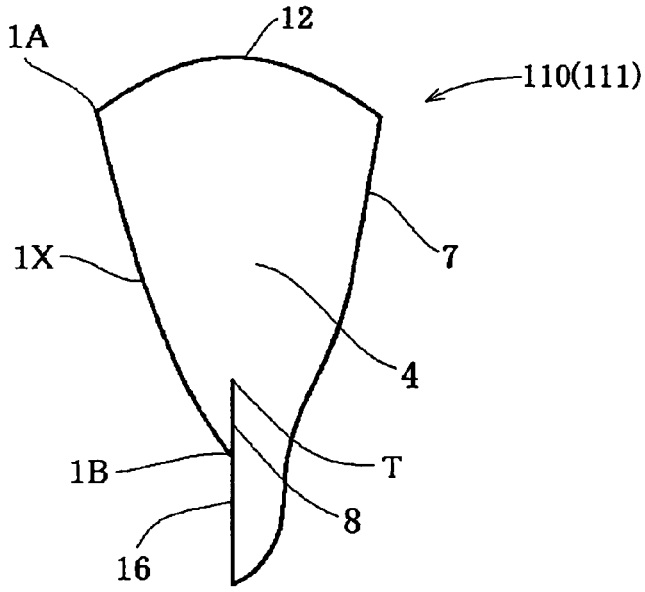
Figure 14:
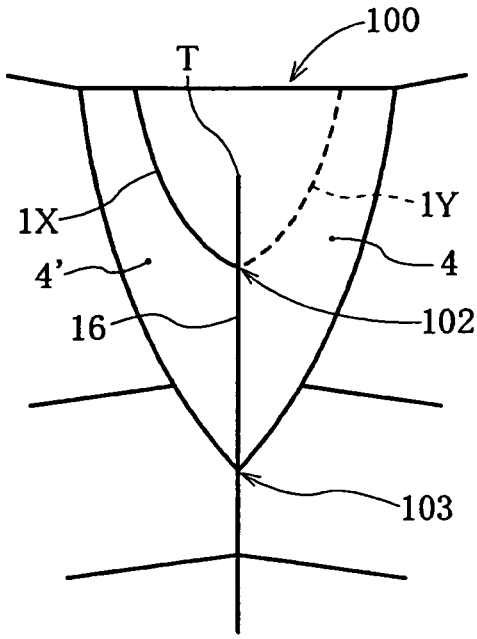
Figure 15:
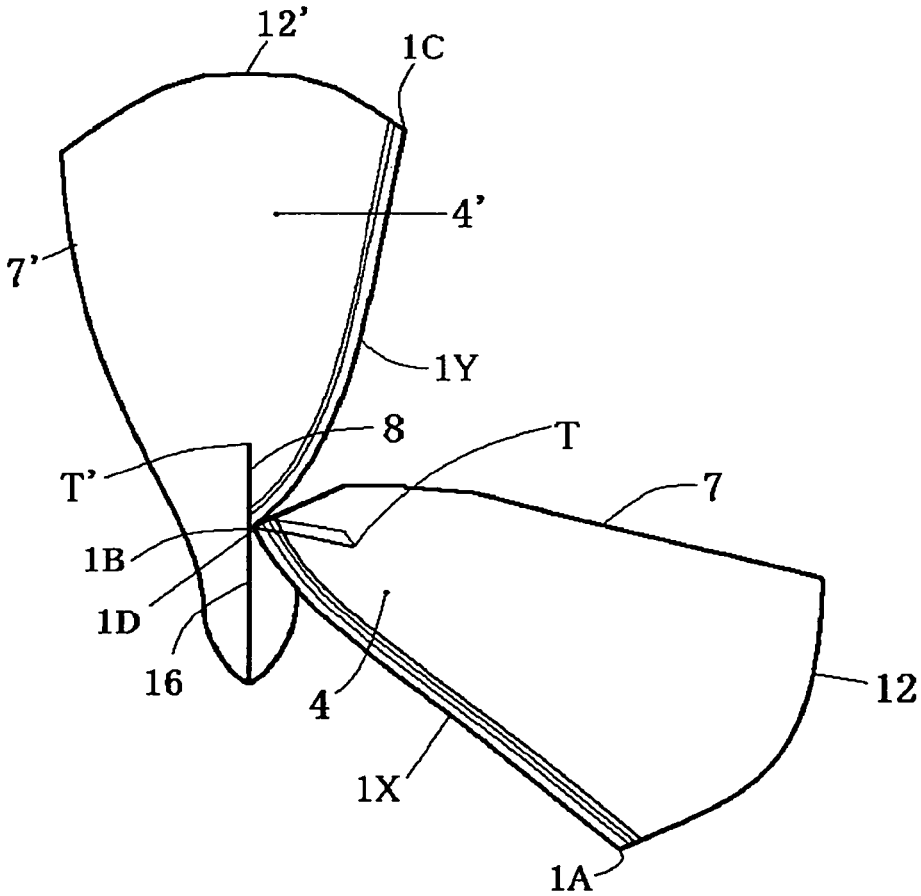
Figure 16:
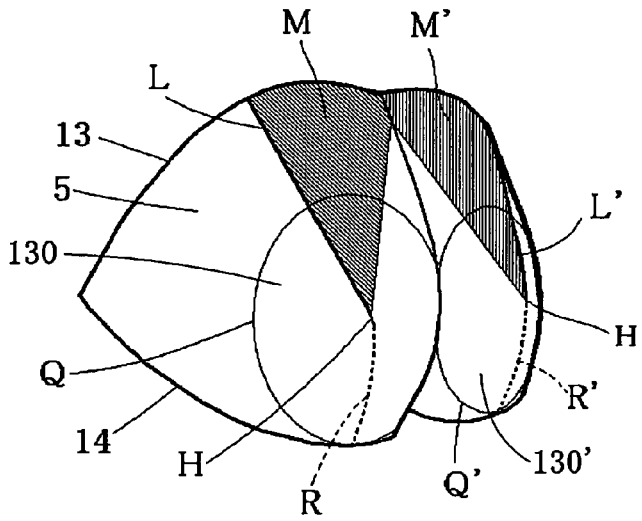
Figure 17:
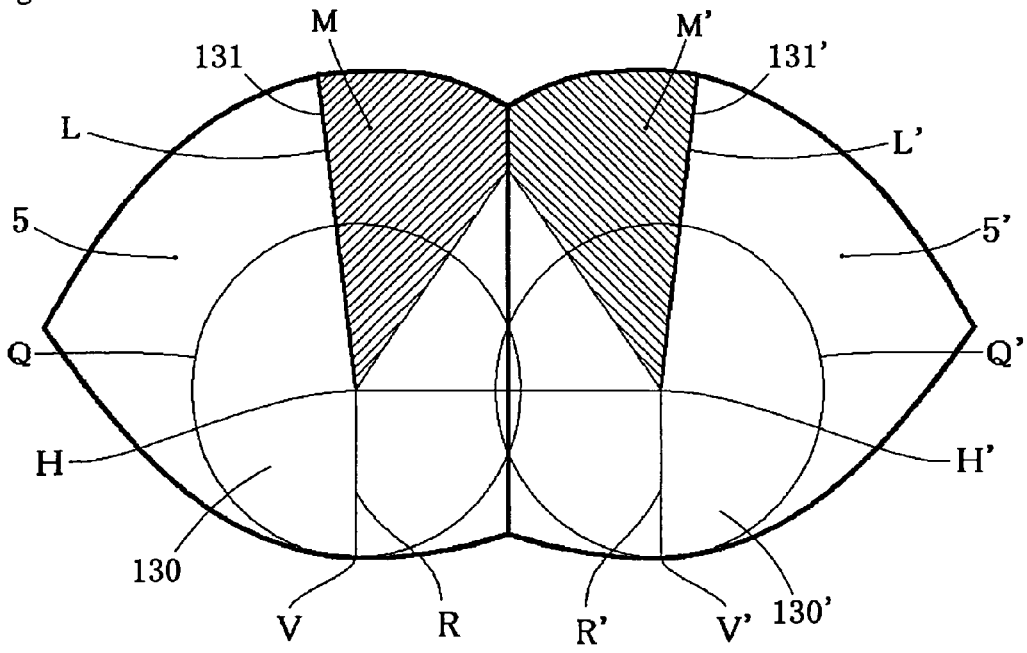
Figure 18:
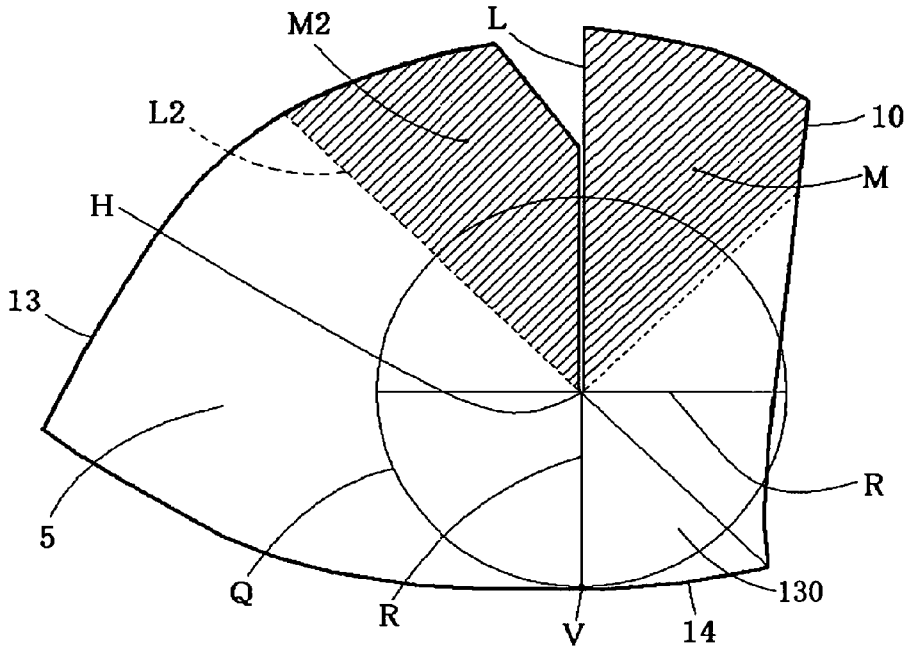
Figure 19:
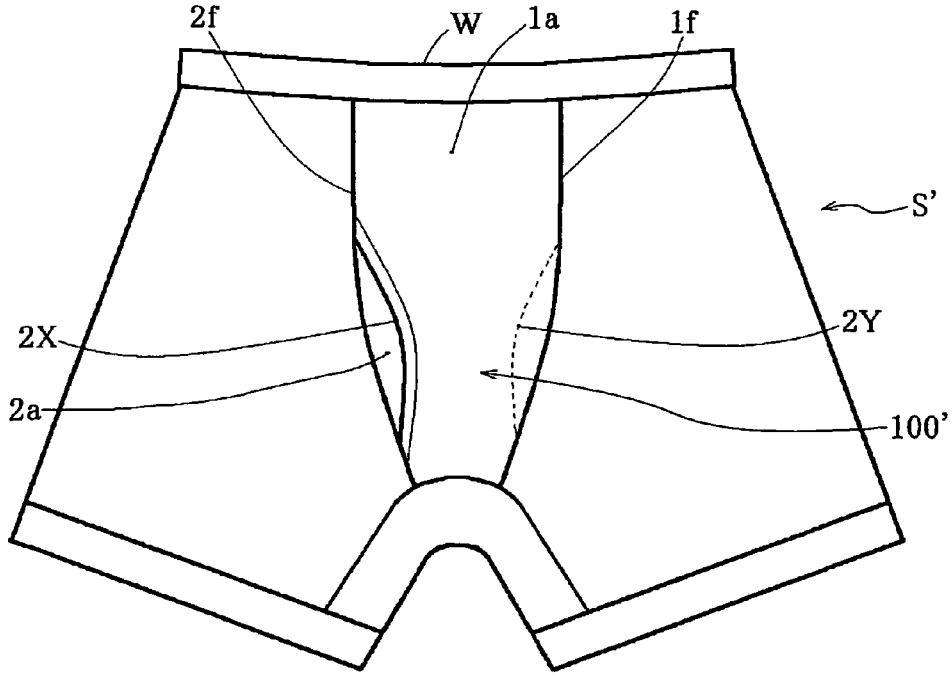
Figure 20:
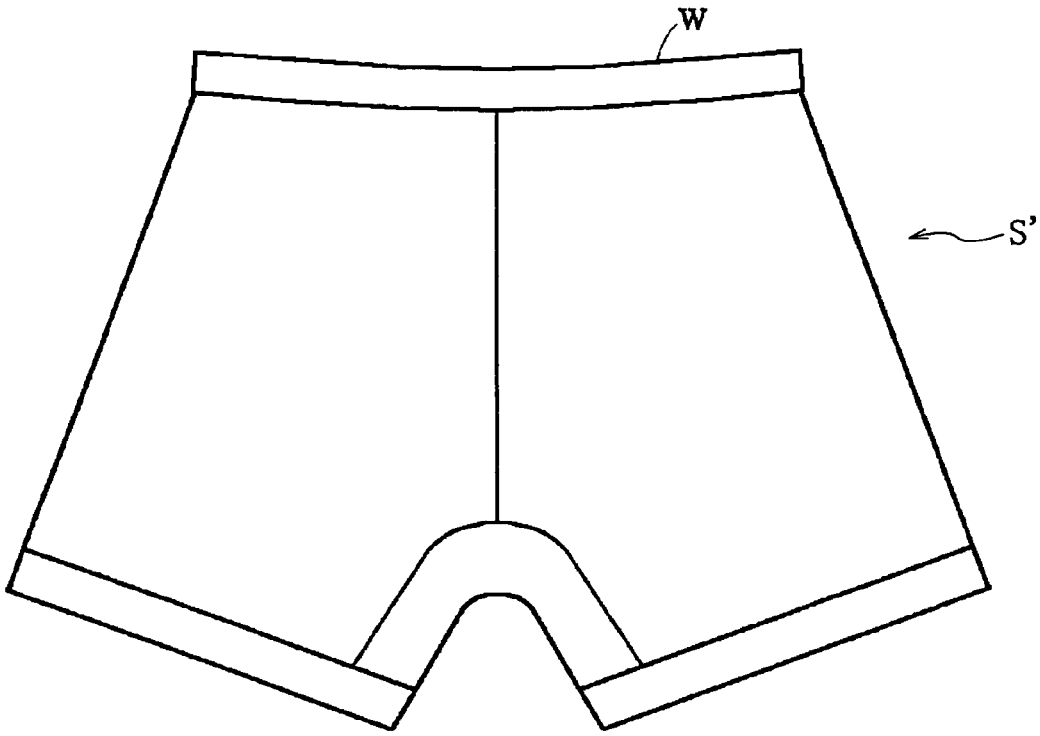
Figure 21:
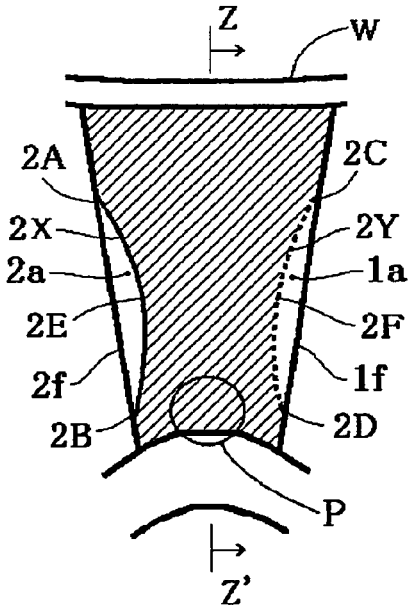
Figure 22:
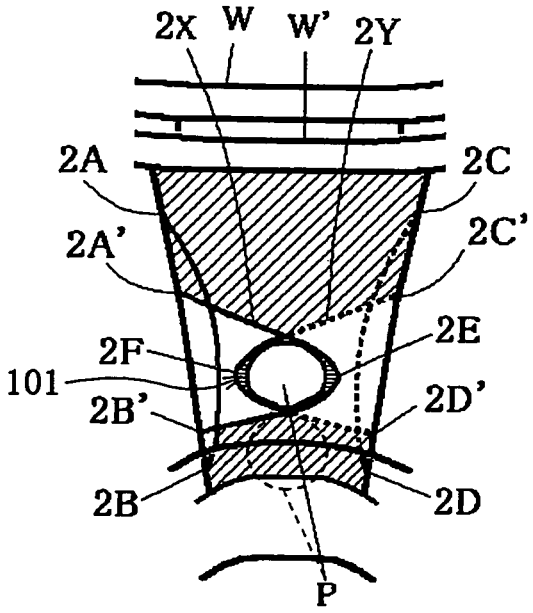
Figure 23:
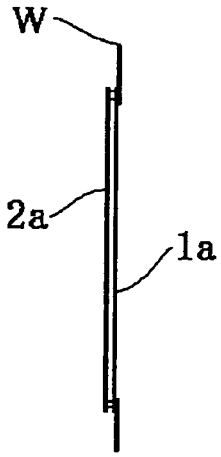

S male shorts
P penis
1X, 1Y edge portions
1B, 1D lower ends
4, 4' cloth members
16 center
100 front opening portion
101 opening
110 engaging means
103 lower end

The invention claimed is:

1. A shorts for a male, the shorts having a front opening portion where two cloth members, each having an inner edge portion and an outer edge portion, are overlapped, the front opening portion being capable of forming an opening allowing insertion of a penis for urination; wherein of respective inner edge portions of the two cloth members forming said opening, an upper end of each inner edge portion is joined in an overlapped manner to the other cloth member;

lower ends of the respective inner edge portions of the two cloth members connect with each other at a vertically-extending joint at a width-wise center of said front opening portion;

an engaging means is provided that comprises a mutual convex overlapping between the two cloth members when the shorts are worn; and said each inner edge portion overlapping the other cloth member and forming said opening is formed convex relative to the vertically-extending joint when the shorts are viewed from the front.

2. The male shorts according to claim 1, wherein said engaging means comprises a convex portion formed by darts treatment provided in each one of the two cloth members.

3. The male shorts according to claim 2, wherein said front opening portion has a vertically elongate, approximately triangular shape;

a top portion of the vertically-extending joint is provided at a vertically intermediate position of the front opening portion; and a lower end of the front opening portion is located on the back side of the base of the penis.

4. The male shorts according to claim 2, wherein the vertically-extending joint is a sewing line connecting the two cloth members with each other.

5. The male shorts according to claim 4, wherein the lower ends of the respective inner edge portions of the two cloth members connect with each other at a top portion of the vertically-extending joint such that when the opening is formed, the respective cloth members pivotably deform about the top portion such that the opening is formed immediately upwardly of the top portion of the vertically-extending joint.

6. The male shorts according to claim 2, wherein the lower ends of the respective inner edge portions of the two cloth members connect with each other at a top portion of the vertically-extending joint such that when the opening is formed, the respective cloth members pivotably deform about the top portion such that the opening is formed immediately upwardly of the top portion of the vertically-extending joint.

7. The male shorts according to claim 1, wherein said front opening portion has a vertically elongate, approximately triangular shape;

a top portion of the vertically-extending joint is provided at a vertically intermediate position of the front opening portion; and a lower end of the front opening portion is located on the back side of the base of the penis.

8. The male shorts according to claim 1, wherein the vertically-extending joint is a sewing line connecting the two cloth members with each other.

9. The male shorts according to claim 8, wherein the lower ends of the respective inner edge portions of the two cloth members connect with each other at a top portion of the vertically-extending joint such that when the opening is formed, the respective cloth members pivotably deform about the top portion such that the opening is formed immediately upwardly of the top portion of the vertically-extending joint.

10. The male shorts according to claim 1, wherein the lower ends of the respective inner edge portions of the two cloth members connect with each other at a top portion of the vertically-extending joint such that when the opening is formed, the respective cloth members pivotably deform about the top portion such that the opening is formed immediately upwardly of the top portion of the vertically-extending joint.

* * * * *